United States Patent [19]

Skorski et al.

[11] 4,299,620

[45] Nov. 10, 1981

[54] LAMELLAR GRAPHITE INOCULANT

[75] Inventors: Roman S. Skorski; Maria B. Skorska, both of Northport, Ala.; Malgorzata B. Skorska, Knoxville, Tenn.

[73] Assignee: The University of Alabama, Tuscaloosa, Ala.

[21] Appl. No.: 107,541

[22] Filed: Dec. 27, 1979

[51] Int. Cl.[3] ..... C22C 33/08

[52] U.S. Cl. ..... 75/53; 75/130 R; 75/130 A

[58] Field of Search ..... 75/53, 130 R, 130 A

[56] References Cited

U.S. PATENT DOCUMENTS 3,321,304 5/1967 Snow ..... 75/130 A 3,656,989 4/1972 Layland ..... 75/130 A

*Primary Examiner*—P. D. Rosenberg

*Attorney, Agent, or Firm*—Oblon, Fisher, Spivak, McClelland & Maier

[57] ABSTRACT

An inoculant for introduction of low temperature boiling metals into molten iron or molten steel, which comprises a combination of an alkaline earth metal selected from the group consisting of calcium, magnesium, and mixtures thereof, and an alkali metal, which metals are intercalated into graphite.

27 Claims, No Drawings

LAMELLAR GRAPHITE INOCULANT

BACKGROUND OF THE INVENTION

1. Field of the Invention

This invention relates generally to inoculants which are useful for introducing low temperature boiling metals into a molten iron or molten steel bath, and more particularly to an inoculant which is a lamellar product of a mixture of two or more metals with graphite.

2. Description of the Prior Art

Low boiling point metals are often needed for various purposes in cast iron production or in steel production. Different low boiling point metals, of course, provide different functions in the iron and steel production. For instance, in steel production, calcium is usually added to the molten bath as a deoxidizer or desulfurizer. In the production of cast iron, a magnesium, calcium or a rare earth metal must be introduced into the molten bath of iron carbide to graphitize the carbide or to effect "nodularization" of the cast iron, which imparts the desirable ductility characteristic of good quality cast iron.

These additives are introduced into the molten bath and volatilized. As the vapors move upward toward the surface of the bath, they enter into reactions with various components of the bath. Unreacted additives escape into the atmosphere and are recovered. It is known, of course, to try to control the rate of volatilization of the additives to provide a more efficient utilization of additives and with consequent reduction in losses.

One technique for effecting such control in the prior art, has been to introduce the volatile metals beneath the surface of the bath by means of a lance, a closed ladle or the like. This method however, is largely ineffective since the metals vaporize so quickly that they soon rise to the surface and dissipate into the atmosphere. This is especially a problem in cast iron production, since if the metal additive volatilizes out of the bath too quickly, the carbide of the batch will be insufficiently graphitized, and the resulting product will not be homogeneous.

To avoid this difficulty, it has been suggested to inoculate molten iron with an alloy which has a higher boiling point than the metal alone. The problem with this technique however, has been the expense of making such alloys, and the risk that the alloying metal will contaminate the product iron or steel. Snow, U.S. Pat. No. 3,321,304, describes still another technique for attempting to control the volatilization of the additive metals. According to the Snow patent, pores of a porous refractory, such as porous coke, graphite, carbon, silicon carbide or the like, is impregnated with a low boiling point metal additive. The difficulty with the Snow technique however, is that volatilization of the metal within the pores will be almost as rapid as volatilization of the free metal itself.

The technique of Snow differs from that of the present invention in that the Snow technique does not lead to metals homogeneously dispersed in the graphite. Thus, the volatilization of any metal which enters the interior portion will be insignificant as compared with the volatilization of the free metal from the pores.

The difficulty with all of these prior art techniques has been that none of them provide for an effectively predictable and controlled quantity of volatilized metal to be introduced into the molten bath, which can be relatively standardized from batch to batch. While the prior art use of free metal alone will provide a predictable quantity of volatilized metal into the bath, the rate of volatilization of free metal is explosively rapid and most of the metal will be lost to the atmosphere. Moreover, even with the addition of a known quantity of free metal to the molten bath, it is completely a matter of chance as to how much of the volatilized metal will remain available for reaction in the molten bath, and how much of the volatilized metal will escape into the atmosphere.

In prior art attempts at control such as disclosed in the Snow patent, while it is less a matter of chance as to how much of the volatilized metal is available for reaction in the molten bath, it is still largely unpredictable from batch to batch as to how much of the volatilized metal will remain in the molten bath for reaction and how much will escape into the atmosphere. The reason for the inability to predict in the Snow procedure is that the size of the pores of the porous refractory can only be estimated and will obviously vary from one porous refractory specimen to another. Thus, the quantity of free metal loaded into the refractory will greatly vary. Moreover, the rate of release will depend on multiple factors pertaining to the nature of the refractory, which of course cannot be standardized.

A need therefore continues to exist for a technique of delivering a low boiling point, highly volatile metal additive to the molten bath of iron or steel, wherein a more predictable, controlled release of volatilized metal can be added to the batch, which will yield a more uniform result from batch to batch of molten metal.

DESCRIPTION OF THE PREFERRED EMBODIMENTS

According to the present invention, an inoculant which permits a very uniform, reproducible introduction of highly volatilizable metal into a molten batch of iron or steel, is provided, by forming a lamellar product of one or more alkaline earth metals, in combination with an alkali metal, in graphite.

The lamellar product is formed by heating a mixture of oxides or salts of the metals while in admixture with the graphite.

Suitable alkaline earth metals usable herein are calcium, magnesium or mixtures thereof. Suitable alkali metals usable herein are any metals of Group I of the Periodic Table, most preferably, potassium or sodium. The alkali and alkaline earth metals are used in the form of their salts, such as the corresponding hydroxide, nitrate, carbonate, phosphate, halide or, less preferably, the sulfate. Good results are also attainable with the use of the corresponding oxides.

The graphite may be non-porous or porous, and may be in the form of graphite per se, or may be graphitized coke, coal, or other carbon source, which may be graphitized prior to use, or may be graphitized in situ during the heating step.

The mixture of salts or oxides and graphite is placed in a furnace, such as an ordinary coking furnace or a basic oxygen furnace, and heated to the melting temperature of the salts or oxides. The alkali metal salts or oxides melt at relatively low temperatures providing a sodium ion containing bath in which the alkaline earth metal is easily dissolved. Interestingly, if an alkaline earth metal salt, such as calcium carbonate, is used alone, without the alkaline earth metal salt, lamellar compounds will not occur. It is theorized that the alkali metal ions facilitate the penetration of the atomic layers by alkaline earth metals in some manner.

After a suitable period of time to effect penetration of the layers, the alkaline earth metal ions will be reduced at the graphite to the free metal, and will be diffused into the lamellar regions of the graphite. The alkali metal ions will likewise be reduced to the free metal, diffused into the graphite and, partially reacted with the carbon to form a mixture of the corresponding alkali carbide and lamellar free alkali metal.

It is, of course, known that alkali metals or salts thereof, will penetrate the atomic layers of with graphite. The loose layered structure of graphite allows many molecules and ions to penetrate the layers to form what are called intercalation or lamellar compounds. Often these may be formed spontaneously when the reactant and graphite are brought together.

Lamellar products of both an alkaline earth metal and an alkali metal, however, have not heretofore been known.

One of the really interesting aspects of the present invention is that the alkaline earth metal and the alkali metal salts or oxides can be used in the form of their raw ores. This is a tremendously important economic advantage, and is a sharp departure from the prior art. In all prior art techniques, the metal additives must be used in the form of the free metals or alloys. Thus, one who wishes to introduce a highly volatile metal additive, would purchase the free metal or alloys, albeit, the user might incorporate the free metal or alloy into a controlled release mode, such as discussed in the aforementioned Snow patent. In contrast, in the present invention, the metallic values need not be separated from the metallic ores, but can be used directly. Thus, an ore containing the alkaline earth metal and an ore containing the alkali metal can be admixed with graphite and subjected to conditions leading to lamellar compounds. The lamellar graphite compounds can then be directly used, rarely with the need for separation of other constituents of the ore.

Suitable natural ores which supply sodium, include soda ash or table salt (NaCl). Suitable ores which supply magnesium, include periclase, magnesite or the like. Suitable ores supplying calcium, include the calcites, such as limestone, chalk or marble, burnt lime or apitate.

Best results have been obtained using dolomite, as a source of both magnesium and calcium, and soda ash.

The calcium should be admixed with the graphite in amounts sufficient to enable 5 to 40% by weight of calcium based on the weight of the lamellar compound and preferably 5 to 30% by weight and most preferably 15 to 25% by weight in the final product. Of course, the calcium will be present both as lamellar calcium and as calcium carbide. About 20% of the calcium in the graphite will be in the form of the carbide.

When magnesium is used, the ore, salt or oxides selected should be sufficient to cause 5 to 30% by weight magnesium, preferably 8 to 20% by weight, and most preferably 10 to 15% by weight to penetrate the layers of graphite.

The alkali metal, preferably sodium or potassium, should be present in large excess since the primary function of the alkali is to act as a bath for the dissolution of the alkaline earth metal salt, and to facilitate penetration by the alkaline earth metal into the layers of graphite. The alkali metals are also quite reactive, and, like the calcium, will form a combination of lamellar alkali and alkali carbide. The alkali will appear in the final lamellar product in an amount of 5 to 40% by weight. One good lamellar composition was found to contain 12% magnesium, 20% calcium, 23% sodium and 45% carbon.

The graphite used to form the lamellar product can be of any size, but it is of no advantage to use large pieces since uniform penetration of the atomic layers will require far too long a period of time. It is most sensible to use powdered or fine particle graphite of a mesh size between ten and twenty-five. These sizes are so small that even if the graphite used is porous graphite, the pore structure is virtually destroyed. This is desirable for two reasons:

First, the smaller the particle size, the faster will be the penetration of. Second, it is not the intention of this invention to have a pore structure which is filled with free metal, since the free metal in the pores will too quickly volatilize in non-controllable, non-reproducible manner when the lamellar product is used as a molten metal bath inoculant. Of course, this is not to say that no pores of the particles will be filled with free metal. It merely indicates that free metal filling of pores is insignificant as compared penetration of the layers.

The mixture of salts or oxides and graphite is heated to a temperature of 900° C. to 1200° C., and preferably 1050° C. to 1100° C. for a period of up to 24 hours for 10 tons of the mixture. Such long heating periods are only required if the furnace is started from room temperature. In industrial production, a heat time of 1 to 5 hours, preferably 2 to 3 hours, will be quite sufficient.

Heating should be continued until the layers of the graphite are uniformly penetrated with the alkaline earth metal. The favorable aspect of the present invention is the fact that the metals are dispersed throughout the graphite on a molecularly uniform level. Thus, it is possible to know fairly accurately how much volatile metal will be in the graphite based on a unit weight of carbon. Moreover, the rate of release of the metal vapors will be quite uniform, and predictable, from batch to batch of molten metal. Since the loading of the graphite does not depend on filling of pores, and in fact the filling of pores is essentially antithetical to this invention, when the inoculant is inserted into the molten iron or steel bath, there is no sudden release of volatilized metal preceding the release of lamellar metal.

Following penetration of the metals into the atomic layers of the graphite, the lamellar product can be used directly as an inoculant for a molten iron or steel bath without cooling, or can be cooled to room temperature for storage or shipping. When the lamellar product is cooled, another interesting phenomena has been observed. Since the penetration process occurs in an excess amount of a bath of the alkali metal salt or oxide, e.g., a sodium carbonate bath, at the termination of the penetration process, the graphite will still be surrounded by the alkali metal salt bath. Upon cooling, a coating of the sodium carbonate will form on the graphite, which is quite advantageous to this invention, since the sodium carbonate coat will act to impart structural rigidity to the graphite and will serve to hold the graphite together during use, even as the metal is rapidly volatizing out.

In the molten iron or steel bath, the graphite will be rapidly adsorbed into the bath, and will become part of the graphite phase. The coating of sodium carbonate serves to slow the adsorption process and thereby reduces further the rate of metal volatilization therefrom.

The lamellar graphite is generally used in an amount of less than 100 pounds per ton of molten iron or steel bath, and generally between 5 and 20 pounds of intercalated graphite per ton. When lamellar graphite contains only calcium and sodium, as a steel deoxidizer, 5 to 15 pounds per ton are usually sufficient, so long as the graphite is adequately loaded as above described.

Other metals can also penetrate the atomic layers of graphite to provide a lamellar product with special properties. For instance, it is desirable to include a rare earth metal, such as cerium in magnesium containing lamellar graphite, since the rate earths are known as exceptional nodularizers when the inoculant is intended for use in cast iron manufacture. The rare earths are only used in relatively trace amounts, usually 0.2 to 0.8% by weight of the total.

It is also desirable to cause iron oxide to penetrate the atomic layers of graphite to add weight to the inoculant. The inoculant will be inserted into the molten iron or steel bath near the bottom of the ladle. It is preferred that the inoculant stay near the bottom of the ladle to maximize the distance the volatilized metal vapors must traverse in the bath, thus increasing the probability of reaction. The penetration of 10 to 25% iron oxide between the atomic layers of graphite adds sufficient weight for this purpose.

Having now generally described the invention, a more complete understanding can be attained from the following examples. It is understood however, that these examples are provided for purposes of illustration only and are not intended to be construed as limiting of the invention.

EXAMPLE 1

A graphite crucible made from an arc furnace graphite electrode was filled with sodium hydroxide mixed with calcium and magnesium oxides in the ratio of 2:1.1, respectively. The crucible was placed in a closed stainless steel container having a methane ($CH_4$) atmosphere. The container was heated in an electric resistance furnace for 2 hours at 1000° C. After cooling, the crucible was cut horizontally and every 3 mm across the 18 mm thick wall, was analyzed spectrographically. The spectrogram indicated that magnesium was the main constituent of the 3 mm thick zone at the inside of the graphite crucible. The next zone was also rich in magnesium, but in the 6th zone, magnesium was hardly noticeable. The last zone was rich in sodium and in a small amount of calcium.

The above experiment was repeated but the salts used contained only sodium and calcium and no magnesium. The treatment consisted of immersing a rectangular block of graphite 5 mm×5 mm×20 mm sample in a molten bath of the sodium and calcium for a period of 4 hours at 880° C. After the treatment, the weight of the graphite had increased about 5% and its volume had increased by about the same amount. The sample was analyzed by the scanning electron microscope with the assistance of the Tuscaloosa Metallurgy Research Center of the Bureau of Mines.

The photomicrograph showed a concentration of Na atoms in the centrally located fracture of a graphite crystal. The Na atom tended to form in the edges along the hexagonal basal planes. Dispersed Ca atoms appeared throughout the entire polycrystalline graphite sample and they appear to have clearly penetrated the layers of the graphite crystals forming thereby lamellar compounds. Evidence of calcium carbide was also apparent.

EXAMPLE 2

A mixture of 184.42 tons of dolomite was admixed with 106 tons of sodium carbonate and 50 tons of coke. The mixture was heated to 1110° C. for 3 hours in a coking furnace. The product consisted of intercalated magnesium and calcium which had penetrated the layers of the graphitized coke forming thereby a lamellar compound.

Test I 20 kilograms of dolomite ($MgCO_3.CaCO_3$), 8 kilograms of soda ash ($Na_2CO_3$) and 3 kilograms of coke (C+6% ash) all in the form of powder about 25 mesh in size, were thoroughly mixed in a steel drum. The drum was then sealed, but in the top and bottom, 3 holes $\frac{5}{8}''$ in diameter were drilled, and in the sides of the drum 4 holes of the same size were drilled. The drum was placed in the center of a coke ove (Empire Coke Co., Holt, Alabama) which then was charged with coal in the normal manner used in producing coke. The coking period was 27 hours during which a maximum temperature of 1050° C. was attained. At the end of the 27-hour period the hot coke was pushed from the oven and quenched with water in accordance with usual coking procedure. The steel drum was recovered intact. Temperature of the charge was still above 100° C. and it appeared that no more than traces of water had penetrated the charge. The steel drum was further cooled to ambient temperature using a blast of air. The contents of the drum were then weighed. The weight of the material was 20 kilograms. This represented a 30% weight loss. The lamellar product consisted of fused (1 to 2 inch diameter) lumps of a bright, white alloy. Chemical analysis of the alloy were as follows:

| Constituent | Weight Percent |
|---|---|
| Mg | 13 |
| MgO | 3 |
| Ca | 3 |
| $Ca_2C$ | 27 |
| CaO | 15 |
| $Na_2CO_3$ | 27 |
| $NaSO_4 + Ca_2P_2O_7$ | <1 |

Inoculation of cast iron was performed with 50 kilograms of molten grey cast iron. One-half kilogram of the inoculant alloy was added. After cooling a sample prepared from the inoculated iron was examined microscopically. The iron was well nodulized.

Test 2

In this experiment, 6 kilograms instead of 3 kilograms of coke were used. The mixture after heating had a grey color apparently due to an excess of carbon. All alloy preparation steps and procedures were the same as those in test 1. The microstructure of the iron alloy after inoculation provided to be well nodulized but the carbon content of the iron was higher than in test 1.

Test 3

In this experiment, 4 kilograms instead of 8 kilograms of $Na_2CO_3$ were used. As before all steps and procedures used are the same as in test 1. After heating, the mixture was poorly fused and powdery. The inoculation of cast iron in this experiment was successful, but difficulty was encountered in introducing the inoculant alloy in the metal. This problem probably could be overcome by modifying the method of inoculation.

Test 4

This experiment was a repeat of test one except that coal was used instead of coke. The raw materials used were, 20 kilograms dolomite, 8 kilograms soda ash and 5 kilograms of coal containing 4% ash, 4% moisture, and 32% volatile matter, mainly hydrocarbons. The heating and coking schedule and procedures used in test 1 were followed. The lamellar graphite product obtained was well fused and when used to inoculant the iron gave about the same results as were obtained in the test with coke.

SUMMARY OF THE INVENTION

Accordingly, it is one object of this invention to provide an inoculant for introduction of low temperature boiling metals into molten iron or steel whereby the release of volatile metals is controlled and relatively predictable from batch to batch to enable more uniform product results.

It is another object of this invention to provide a technique for causing metals to penetrate the layers of graphite without prior separation of the metallic values from the raw ores.

It is still further an object of this invention to provide an inoculant which has unusal stability when placed into a molten iron or steel batch.

These and other objects of this invention, as well become clearer from the following description have been attained by providing an inoculant for introduction of low temperature boiling metals into molten iron or molten steel, which comprises a combination of an alkaline earth metal selected from the group consisting of calcium, magnesium, and mixtures thereof, and an alkali metal, which metals form lamellar compounds with graphite.

This inoculant is produced by admixing graphite with a combination of salt or oxide of an alkaline earth metal selected from the group consisting of calcium, magnesium and mixtures thereof and a salt or oxide of an alkali metal, and heating the mixture to above the melting temperature of said salts or oxides and wherein said mixture is maintained for a time sufficient to enable uniform penetration of the alkaline earth metal and said alkali metal between the atomic layers of said graphite.

What is claimed as new and desired to be secured by Letters Patent of the United States is:

1. An inoculant for introduction of low temperature boiling metals into molten iron or molten steel, which comprises a combination of an alkaline earth metal selected from the group consisting of calcium, magnesium, and mixtures thereof, and an alkali metal, which metals penetrate the atomic layers of graphite, forming thereby lamellar compound.

2. The inoculant of claim 1, wherein said alkali metal is sodium.

3. The inoculant of claim 1, wherein said alkaline earth metal is calcium.

4. The inoculant of claim 1, wherein said alkaline earth metal is magnesium.

5. The inoculant of claim 1, wherein said inoculant is a combination of magnesium and calcium.

6. The inoculant of claim 1, wherein said inoculant contains said calcium in the form of a mixture of calcium and calcium carbide.

7. The inoculant of claim 1, wherein said lamellar product contains a minor amount of a rare earth metal.

8. The inoculant of claim 7, wherein said rare earth metal is cerium.

9. The inoculant of claim 1, wherein said alkaline earth metal is present in said lamellar graphite in an amount sufficient such that sufficient metal is introduced into said molten iron or molten steel to effect deoxidation of said molten steel, or nodularization of said molten iron within a metallurgically acceptable volume of total graphite inoculant.

10. The inoculant of claim 1, wherein said alkali metal is potassium.

11. The inoculant of claim 1, wherein said lamellar graphite contains an amount of iron oxide sufficient to enable said inoculant to remain in the lower portion of the molten iron or molten steel for a period of time sufficient to enable good distribution of the volatile gases within said molten iron or steel.

12. A process for producing the inoculant of claim 1, wherein a combination of salt or oxide of an alkaline earth metal selected from the group consisting calcium, magnesium and mixtures thereof, and a salt of oxide of an alkali metal, is admixed with graphite, and the mixture is heated to above melting temperature of said salts or oxides and wherein said mixture is maintained, for a time sufficient to enable uniform penetration of the alkaline earth metal in said alkali metal between the atomic layers of said graphite, forming thereby lamellar compounds.

13. The process of claim 12, wherein said alkaline earth metal is calcium.

14. The process of claim 13, wherein said calcium salt is used in the form of limestone or burnt lime.

15. The process of claim 12, wherein said alkaline earth metal is magnesium.

16. The process of claim 15, wherein said magnesium salt is magnesium carbonate.

17. The process of claim 12, wherein said alkaline earth metal is a combination of calcium and magnesium.

18. The process of claim 17, wherein said salts are used in the form of dolomite.

19. The process of claim 12, wherein said alkali metal is sodium.

20. The process of claim 19, wherein said sodium is used in the form of soda ash.

21. The process of claim 12, wherein the graphite is admixed with dolomite in an amount sufficient to provide sufficient magnesium and calcium for subsequent desulfurization and nodularization to a molten iron bath to which the inoculant will subsequently be applied, and a quantity of soda ash or sodium hydroxide in a substantial excess of that needed to dissolve said dolomite, and said admixture is heated to effect penetration of the sodium, calcium and magnesium between the atomic layers of said graphite, forming thereby lamellar compounds.

22. The process of claim 12, wherein said admixture contains a rare earth metal.

23. The process of claim 12, wherein said intercalated graphite is cooled to enable sodium carbonate to solidify and coat the surface thereof.

24. The process of claim 12, wherein said graphite is in the form of a powder.

25. An inoculant for introduction of low temperature boiling metals into molten iron or molten steel, which comprises a combination of an alkaline earth metal selected from the group consisting of calcium, magnesium, and mixtures thereof, and an alkali metal which metals penetrate the atomic layers of graphite forming lamellar compounds and wherein said graphite is a non-porous powder having a particle size between ten and twenty-five mesh.

26. A process for producing the inoculant of claim 1 wherein a combination of an ore containing an alkaline earth metal selected from the group consisting calcium, magnesium and mixtures thereof, and an ore containing an alkali metal is admixed with graphite and the mixture is heated to above the melting point of said ores and wherein said mixture is maintained for a time sufficient to enable uniform penetration of the alkaline earth metal and the alkali metal between the atomic layers of said graphite, forming thereby lamellar compounds.

27. An inoculant for introduction of low temperature boiling metals into molten iron or molten steel, which comprises a combination of an alkaline earth metal selected from the group consisting of calcium, magnesium and mixtures thereof, and an alkali metal, which metals penetrate the atomic layers of graphite forming thereby lamellar compounds, and wherein the lamellar graphite is coated with an alkali metal salt sufficient to impart structural integrity.

* * * * *

UNITED STATES PATENT AND TRADEMARK OFFICE

CERTIFICATE OF CORRECTION

PATENT NO. : 4,299,620

DATED : November 10, 1981

INVENTOR(S) : Roman S. Skorski et al.

It is certified that error appears in the above—identified patent and that said Letters Patent is hereby corrected as shown below:

On The Title Page, item (75) should read

-- (75) Inventors:

Roman S. Skorski; and Maria B. Skorska, both of Northport, Ala. --.

Signed and Sealed this

*Eleventh* Day of *May 1982*

[SEAL]

*Attest:*

GERALD J. MOSSINGHOFF

*Attesting Officer*

*Commissioner of Patents and Trademarks*